United States Patent [19]

Smith et al.

[11] 3,960,052

[45] June 1, 1976

[54] WEAPON ARRANGEMENT

[76] Inventors: Matthew S. Smith, 4400 Sarah St. No. 29, Burbank, Calif. 91505; Ernest A. Filippi, 18776 Kenya St., Northridge, Calif. 91324

[22] Filed: Oct. 18, 1974

[21] Appl. No.: 516,037

Related U.S. Application Data

[62] Division of Ser. No. 307,444, Nov. 17, 1972.

[52] U.S. Cl. ..... 89/37 BA; 89/40 E

[51] Int. Cl.[2] ..... F41C 29/00

[58] Field of Search ..... 42/1 F, 94; 89/1.818, 89/37 BA, 40 E; 102/65.2

[56] References Cited

UNITED STATES PATENTS

| | | | |
|---|---|---|---|
| 1,317,419 | 9/1919 | Bergman | 89/40 E |
| 1,320,702 | 11/1919 | Messersmith | 89/40 E |
| 1,407,567 | 2/1922 | O'Malley | 89/40 E |
| 1,735,164 | 11/1929 | Green | 89/40 E |
| 2,870,683 | 1/1959 | Wilson | 89/40 E |

FOREIGN PATENTS OR APPLICATIONS

| | | | |
|---|---|---|---|
| 707,544 | 4/1965 | Canada | 102/65.2 |
| 1,457,599 | 9/1966 | France | 89/37 BA |

OTHER PUBLICATIONS

Matthew S. Smith, Stability and Dispersion Analysis for Rockets and Projectiles, 1970, pp. 85–106.

Davis et al, Exterior Ballistics of Rockets, 1958, pp. 137, 147.

Merrell, Dictionary of Guided Missiles and Space Flight, 1959, pp. 117, 118, 585.

Rosser et al, Mathematical Theory of Rocket Flight, 1947, pp. 59, 71.

*Primary Examiner*—Stephen C. Bentley

*Attorney, Agent, or Firm*—Don B. Finkelstein

[57] ABSTRACT

A rocket boosted and/or sustained round for launching from a firearm, recoilless rifle, mortar or any other type of closed breech launcher and an adjustable, recoiling tripod support for the firearm or other type of closed breech launcher. The tripod supports the launcher during launch of the rocket boosted and/or sustained round. The rocket boosted round, which may be launced, for example, from the conventional M-16 rifle, is aerogyro stabilized and is provided with a tubular tailpipe that slidingly fits over the end of the firearm barrel. A rocket motor which is ignited during or after launch is coupled to the tailpipe and a warhead having a predetermined ogive configuration is coupled to the rocket motor. An ignition delay means in the round such as a pyrotechnic delay may be provided to allow a predetermined time delay between launch of the round and the ignition of the rocket motor. Other round configurations incorporate a progressive burning rocket motor grain instead of a pyrotechnic delay. The low thrust and negligible back blast from the initial burn of the rocket allows the elimination of the time delay from launch to rocket motor ignition. The round is launched by firing a grenade launcher cartridge in the launcher. The hot, gaseous products of combustion from the cartridge enter the tailpipe of the round and launch the round from the launcher. The ignition delay means if utilized, initiates ignition of the rocket motor after a predetermined time interval has elapsed from launch.

3 Claims, 15 Drawing Figures

WEAPON ARRANGEMENT

This is a division, of application Ser. No. 307,444, filed Nov. 17, 1972.

In the progressive burn configuration the rocket motor ignites while on the launcher. In order to achieve zone firing, various shrouds may also be provided. For example, to achieve the longest range firing, a streamlined fairing maybe coupled between the warhead and the tailpipe to provide minimum drag configuration for maximum ranging. If shorter ranges are desired one or more drag shrouds may be coupled to the round to decrease the range. For minimum range, a plug is inserted in the tailpipe to prevent ignition of the rocket motor and the round follows a ballistic trajectory after launch. The tripod support is a recoil energy dissipating type of support and is detachably mountable on the launcher, preferrably without modification or change to the launcher. During firing the tripod support time to full recoil is considerably greater than the time required for the rocket round to leave the launcher. Thus the rocket round starts free flight without the introduction of launch perturbations. The tripod support is adjustable to provide a plurality of different launch angles for launching of the round from the launcher and is foldable from the firing positions to a folded position providing a minimum package configuration for convenience in transportation thereof.

BACKGROUND OF THE INVENTION

1. Field of the Invention

This invention relates to the weapons art and more particularly to an improved rocket boosted round launched from a closed breech launcher such as a firearm and also an improved tripod support for the launcher.

2. Description of the Prior Art

Rocket boosted rounds launched from firearms or other closed breech launchers, have heretofor been utilized to provide increased fire power greater than the firepower than the firepower normally attainable from the firearm. However, the known prior art rocket boosted rounds have generally not been able to be rapidly fired from the launcher nor have they provided a high degree of accuracy. That is, even though such rounds were repetitively fired from substantially the same position the points of impact thereof would be widely varied. Further, zoning to provide variations in the range of the rocket boosted round have not been achievable with such prior art rounds since no structure was provided for controlling range of the round after launch.

Various tripod supports heretofor utilized to support a launcher for launching of rocket boosted rounds therefrom have generally not provided a satisfactory, stable launching platform that could be accurately or repetitively set up in a firing position and maintained in that position for repeated firings of the rounds. Additionally, accurate arranging of the tripod support to provide accurate variations in the angle of elevation have generally not been attainable in comparatively light weight, easily portable and economical tripod supports.

Thus, there has long been a need for an improved rocket boosted warhead round for launching from, for example, a firearm, and an improved tripod launching support for the firearm.

SUMMARY OF THE INVENTION

Accordingly, it is object of present invention to provide an improved rocket boosted warhead round for launch from a closed breech launcher such as a firearm.

Another object of the present invention is to provide an improved rocket boosted warhead round having aero-gyro stability;

It is another object of the present invention to provide an improved rocket boosted warhead round for launch from a closed breech launcher in which variations in range zoning mmay be quickly and easily achieved.

It is yet another object of the present invention to provide an improved tripod support for a launcher during launch of a rocket boosted warhead round.

It is still another object of the present to provide an improved tripod support that is comparatively light weight, easily transportable and ruggedly constructed to withstand long periods of service utilization.

The above, and other objects of the present invention are achieved by providing a rocket boosted warhead round having a tailpipe that slidingly fits over the barrel of a closed breech launcher which may be a conventional firearm such as, for example, the M-16 rifle. Aero-gyro stabilization means such as a ring tail and canted fin arrangement are provided on the tailpipe to achieve aero-gyro stabilization during the flight of the round. A rocket motor is coupled to the tailpipe and a warhead is coupled to the rocket motor. The round is launched by firing a blank cartridge in the firearm and the hot products of combustion from the blank cartridge both launch the rocket boosted warhead round as well as initiate the ignition of the rocket motor. In one embodiment of the rocket boosted warhead round an ignition delay means is provided and the rocket motor does not ignite until a predetermined time, for example on the order of one-tenth of a second, after launch from the firearm. Because of the aero-gyro stability means provided the rocket boosted warhead round has achieved a spin rate that is an order of magnitude greater than they yawing frequency of the round within the approximately one-tenth of a second and the rocket motor is then ignited to provide the rocket boost to the round.

In another embodiment of the rocket boosted warhead round a progressive burning propellant grain is utilized. The thrust and back blast from the ignited rocket motor is selected to be comparatively small at ignition. This allows safe launch, without hazard to the firing personnel or equipment, and stable separation from the launcher.

In order to achieve zoning, the basic rocket boosted warhead round may be provided with one or more drag means detachably mountable thereon to increase the drag and thus provide less range for a given angle of launch. Similarly, if a greater range is desired, there may be provided a streamlined fairing, which may be detachably mountable on the round, to achieve a greater range for a given angle of launch than is achieved without the fairing.

In order to achieve minimum range a plug is inserted into the tailpipe to prevent ignition of the rocket motor. The round is then launched from the launcher, as above described, and follows a ballistic trajectory without any boost from the rocket motor.

The improved tripod support of the present invention, which may be utilized for supporting any launcher when launching the above described improved rocket boosted warhead round, or launching any other round, incorporates a body member to which a base leg is coupled and onto which a pair of forward legs are pivotally coupled. The base leg and the pair of forward legs are in spaced relationship to each other. The pair of forward legs are movable, with respect to the base leg and body member, to provide variations in angle of launch. A launcher support means is coupled to the body member and preferably incorporates a recoil means for dissipating at least a portion of the recoil energy applied thereto when the blank cartridge is fired. The tripod support structure provides uniform, linear motion of the recoil means and the launcher during at least the time interval between firing the blank cartridge and when the round is free of the launcher is order to avoid inducing perturbations in the trajectory of the round. The support means also incorporates a clamping means for clamping the tripod to the launcher. Preferably, the clamping arrangement for clamping between the tripod and the launcher does not require any modification to the launcher.

BRIEF DESCRIPTION OF THE DRAWINGS

The above and other objects of the present invention may be fully understood from the following detail description taken together with the accompanying drawings wherein similar reference characters refer to similar elements throughout and in which.

DESCRIPTIONS OF THE PREFERRED EMBODIMENTS

The present invention comprises an improved rocket boosted warheaad round and an improved tripod support arrangement for supporting the launcher from which the round is launched. It will be appreciated that the improved rocket boosted warhead round of the present invention may be utilized in any launcher supported by any means. Similarly, the tripod support structure of the present invention may equally well be utilized to support any launcher for launching any other type of round therefrom.

In the following detailed description of the structure associated with the preferred embodiments of the present invention, the rocket boosted warhead round is illustrated as launched from a standard M-16 rifle with a tripod support clampingly engaging the M-16 rifle for support thereof during launch of the round. However, the invention is not limited utilization only with an M-16 rifle and any other type of launcher desired may equally well be utilized in accordance with the present invention.

Figure 1A:
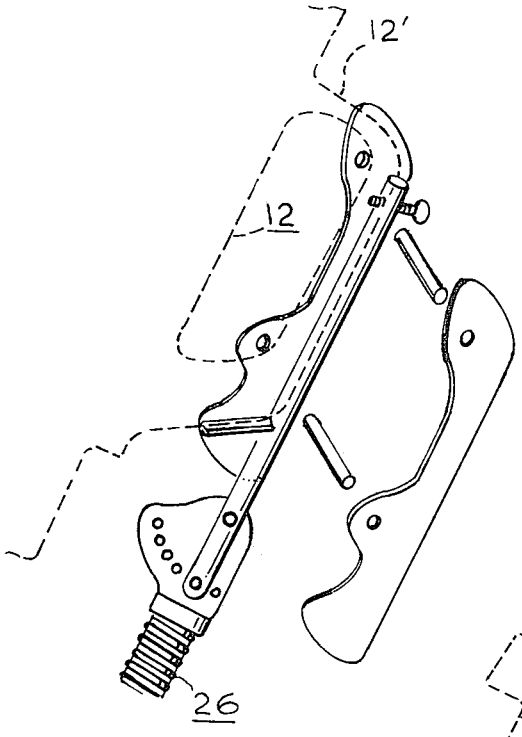
FIG. 1 illustrates one embodiment of the present invention position for a high angle launch.
Figure 1:
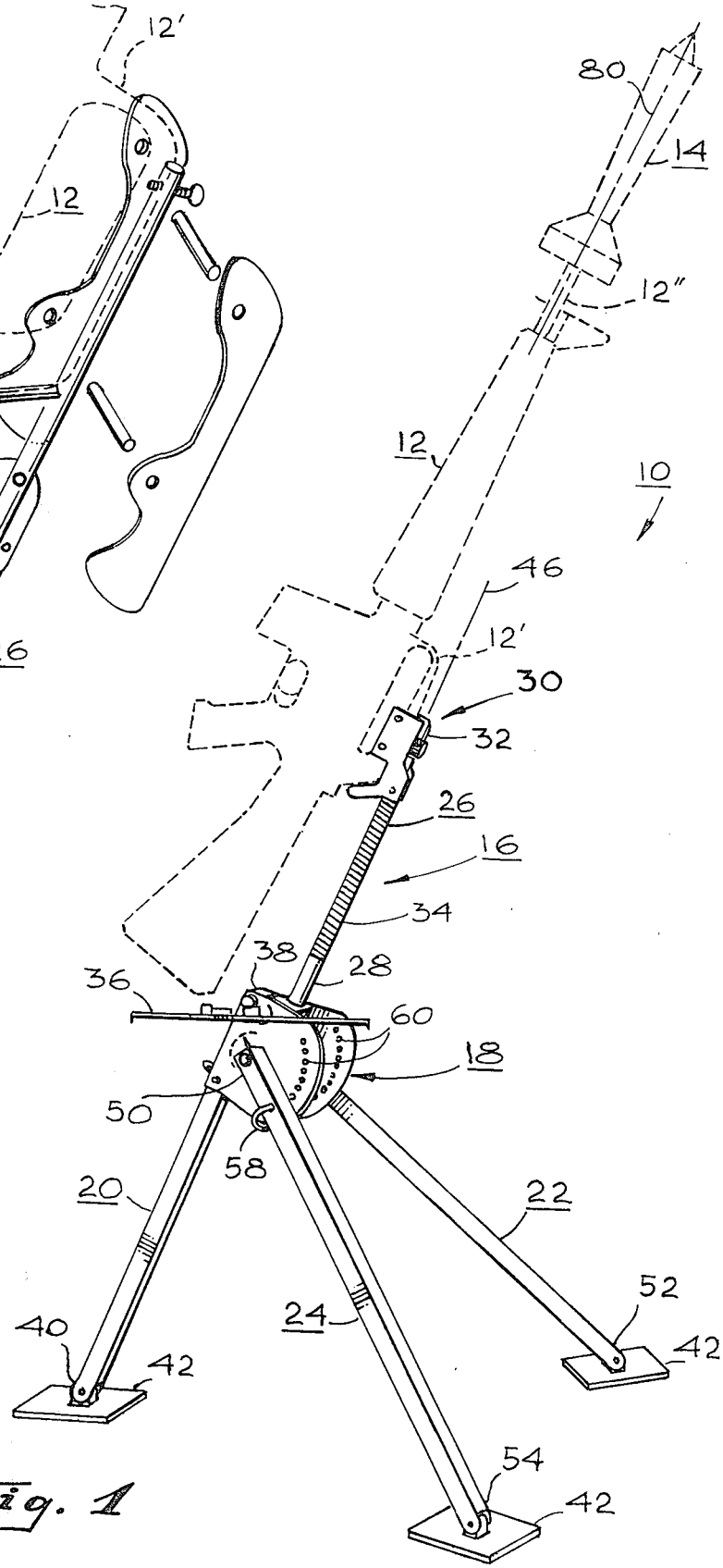
Figures 2, 6, 7, 8, 14:
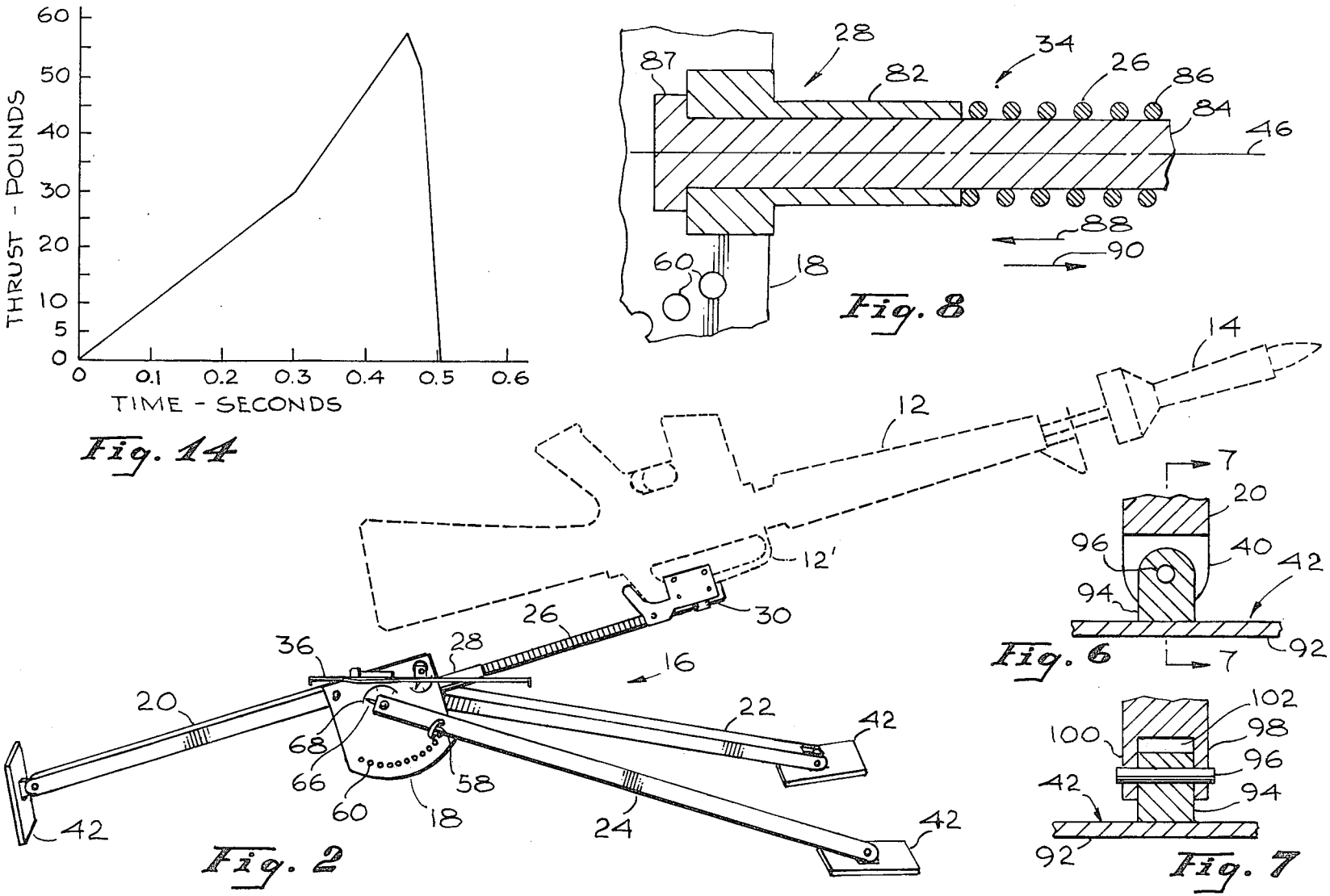
FIG. 2 illustrates the embodiment shown in FIG. 1 positioned for a low angle launch.
FIGS. 6 & 7 are sectional views illustrating a footpad useful in the present invention.
FIG. 8 is a partial sectional view illustrating the recoil energy dissipating means useful in the practice of the present invention.
FIG. 14 is a graphical representation of the thrust-time curve of a rocket motor useful in the practice of the present invention.

Referring now to the drawing, there is illustrated in FIGS. 1 and 2 the structure associated with a preferred embodiment of the present invention, generally designated 10. FIG. 1 shows the embodiment 10 positioned for a high angle launch and FIG. 2 shows the embodiment 10 positioned for a low angle lauch. A conventional M-16 rifle is illustrated herein as the launcher 12 from which the rocket boosted warhead round 14 is launched. The M-16 rifle, or launcher 12, is supported on a tripod launch support 16.

The tripod launch support 16 generally comprises a body member 18 supported on a base leg 20, and a pair of forward legs 22 and 24. A launcher support means 26 has a first end 28 coupled to body member 18 and a second end 30 spaced from the first end 23 and a launcher clamping means 32 is coupled to the second end 30 of the launcher support means 26. The launcher clamping means 32 provides a clamping arrangement which, in the preferred embodiment 10 of the present invention is a detachable clamping arrangement for clamping to the M-16 rifle 12. In accordance with the principals of the present invention the detachable clamping arrangement provided by the launcher clamping means 32 requires no modification to the M-16 rifle or to any other launcher on which it maybe utilized. That is, those skilled in the art may easily determine the minor modifications in structure from the illustrated embodiments necessary to provide detachable clamping to any type of launcher without modification thereto.

A recoil energy dissipating means 34 is coupled to the launcher support means 26 and provides energy dissipation for dissipating at least a portion of the recoil energy imparted thereto during launch of the rocket boosted warhead round 14.

A level means 36 is pivotally mounted on the body member 18 and is alignable thereon in a level condition for depicting a level condition of the tripod launcher 16 for the conditions of the tripod launcher 16 in any of the firing positions.

A first end 38 of the base leg 20 is coupled to the body member 18 and a second end 40 is spaced from the first end 38. A footpad means 42 is pivotally mounted on the second end 40 of the base leg 20 and has a predetermined surface bearing area for supporting the base leg 20 during launch of the rocket boosted warhead round 14.

The base leg 20 extends from the body member 18 in a first direction, indicated by the axis 44, and the launcher support means 26 extends from the body member 18 in a second direction, indicated by the axis 46. In the preferred embodiment of the present invention the first direction indicated by axis 44 lies in a plane substantially parallel to the plane containing axis 46 of the second direction. In other embodiments, the first axis 44 may be colinear with the second axis 46 and the launcher support means 26 may be aligned with base leg 20.

Both FIGS. 1 and 2 illustrate the tripod support arrangement 18 in firing positions thereof and the base leg 20 is rigidly clamped to the body member 18 for condition of the tripod launch support 18 in any desired firing position.

The tripod support arrangement provides variation in the firing position to provide various angles of launch for the rocket boosted warhead round 14. Variation in the angle of launch is achieved by providing first ends 48 and 50 of forward legs 22 and 24, respectively, pivotally mounted on the body member 18 and second ends 52 and 54, respectively, spaced from the first end 48 and 50, a preselected distance. The forward legs 22 and 24 are in a predetermined spaced array to each other and to the base leg 20 to provide appropriate three point support for the launcher 12. Footpads 42 are coupled to each of the second ends 52 and 54 of the forward legs 22 and 24, respectively, to provide appropriate bearing surface support therefore during launch of the rocket boosted round 14. The forward legs 22 and 24 are pivotally movable on the body member 18 in the direction indicated by the double ended arrow 56 to provide variations in the desire angle of launch.

Figure 3:
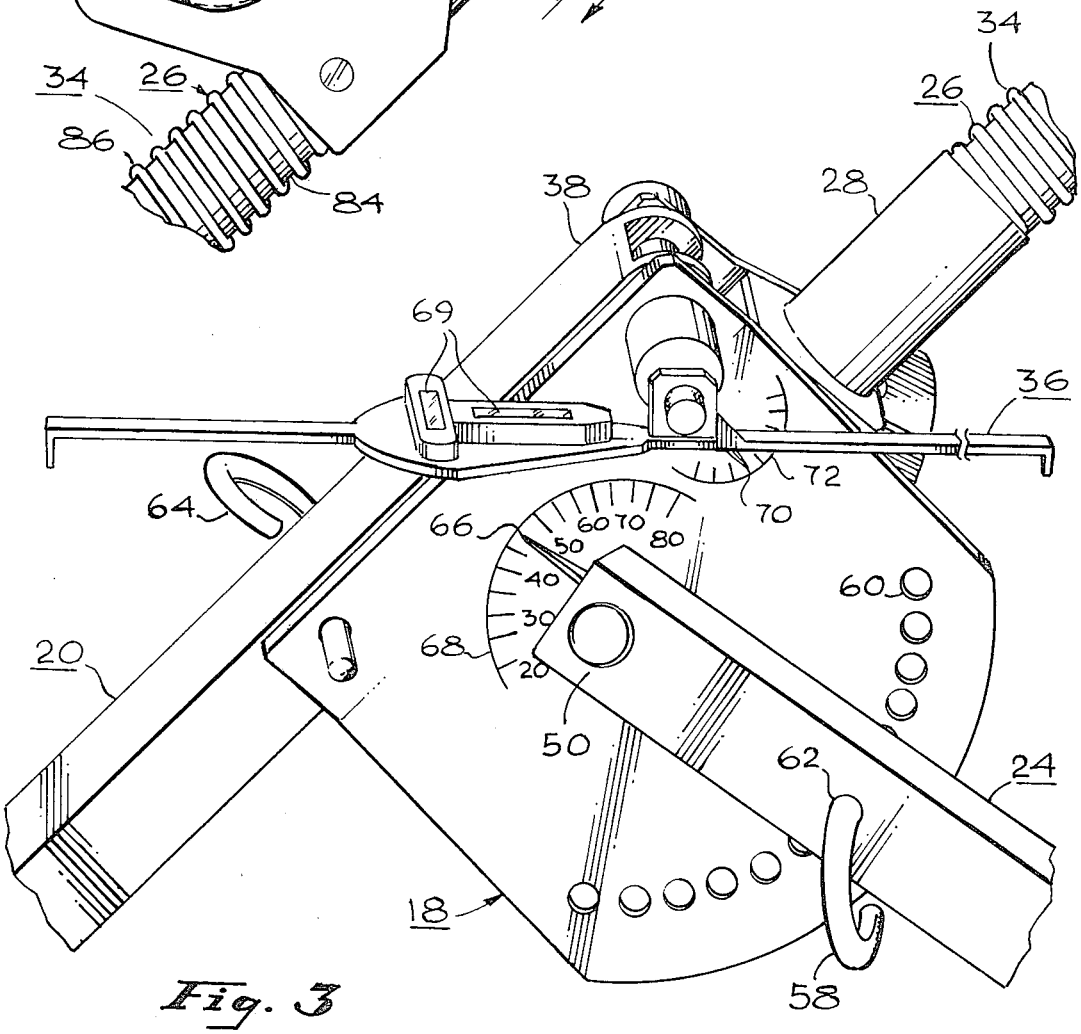
FIG. 3 illustrate the structure associated with an embodiment of the present invention.

A forward leg clamping means 58 operatively engages each of the forward legs 22 and 24 and the body member 18 for detachable clamping of each of the forward legs 22 and 24 in any of the plurality of firing positions. The forward leg clamping means 58 may comprise pin type structures extending through each of the legs 22 and 24 and through any of the aligned apertures 60 provided in body member 18, as shown in greater detail on FIG. 3, which illustrates the detachable clamping of the forward leg 24 to the body member 18 which structure, it will be appreciated, is substantially identical to the structure utilized for detachably clamping forward leg 22 to the body member 18. The pin like forward leg clamping means 58 extends through an aperture 62 in the forward leg 24 and into one of the plurality of apertures 60 in the body member 18 to provide detachable clamping therebetween.

The base leg 20, noted as above, is rigidly clamped to the body member 18 for all firing positions of the forward legs 22 and 24. That is, for the condition of the forward legs 22 and 24 clamped by the forward leg clamping means 58 to the body member 18 in any of the plurality aperture 60, the base leg 20 is rigidly coupled to the body member 18.

In the preferred embodiment of the present invention 10, the forward legs 22 and 24, as well as the base leg 20, are foldable from any of the firing positions to a folded position wherein each of the legs are aligned substantially parallel to the launcher support means 26. Therefore, when the first end 38 of the base leg 20 is pivotally coupled to the body member 18 a base leg clamping means 64 extends through the base leg 20 and into the body member 18 to retain base leg 20 in a firing position thereof for all firing positions of the forward legs 22 and 24.

In the embodiment 10 there are provided 13 apertures 60 to accommodate variations in launch angle of the rocket boosted warhead round 14 for launch angles between 20 degrees and 80 degrees from the horizontal in five degree increments. It will be appreciated, however, that any desired number of apertures providing any desire range of launch angles and any individual launch angle within such a range could be provided. For example, instead of plurality of discrete apertures 60, an arcuate slot could be provided in body member 18 adjacent to each of the forward legs 22 and 24 to provide an infinitely adjustable launch angle within the range of launch angles allowed by the length of the arcuate slot. Suitable clamping means, such as screws or the like could be utilized, as desired, to support each of the forward legs 22 and 24 in any desired launch angle in such a slot.

In order to achieve visual indication of the selected launch angle, the embodiment 10 is provided with a pointer means 66 coupled to the first ends 48 and 50 of each of the forward legs 22 and 24 respectively and a launch angle scale 68 adjacent thereto on the body member 18. Pointer means 66 is aligned with the center line of the pivotal connection of the forward legs 22 and 24.

The level means 36, as noted above, is pivotally connected to the body member 18 and the level means 36 comprises a level indicating means in which there are a pair of orthogonally aligned bubble sight levels 68 coupled thereto, a pointer means 70 coupled to the level means 36 and a level scale 72 on the body member 18 adjacent to the pointer means 70. The level scale 72 is calibrated to provide correspondence to the launch angle scale 68 so that, for example, if a true launch angle of 45 degrees is desired the forward legs 22 and 24 are detachably clamped in the appropriate one of the plurality of apertures 60 so that the pointer 66 indicates a 45 degree launch angle on the launch angle scale 68. The level means 46 is then pivotally adjusted to the 45 degree marking on the level scale 72. If the tripod support 16 is placed upon horizontally level ground, the sight level would indicate the level condition. However, if there are undulations or variations from the horizontal, the sight level will indicate the non-level condition and the position of the footpads 42 coupled to each of the legs must be suitably adjusted to obtain the true level condition.

It will be appreciated that in other embodiments of the present invention wherein the folded position, which provides convenience for logistics and transportation of the tripod support 16, is not required, the base leg 20 may be rigidly coupled, and aligned in the first direction, to the body member 18.

Figure 5:
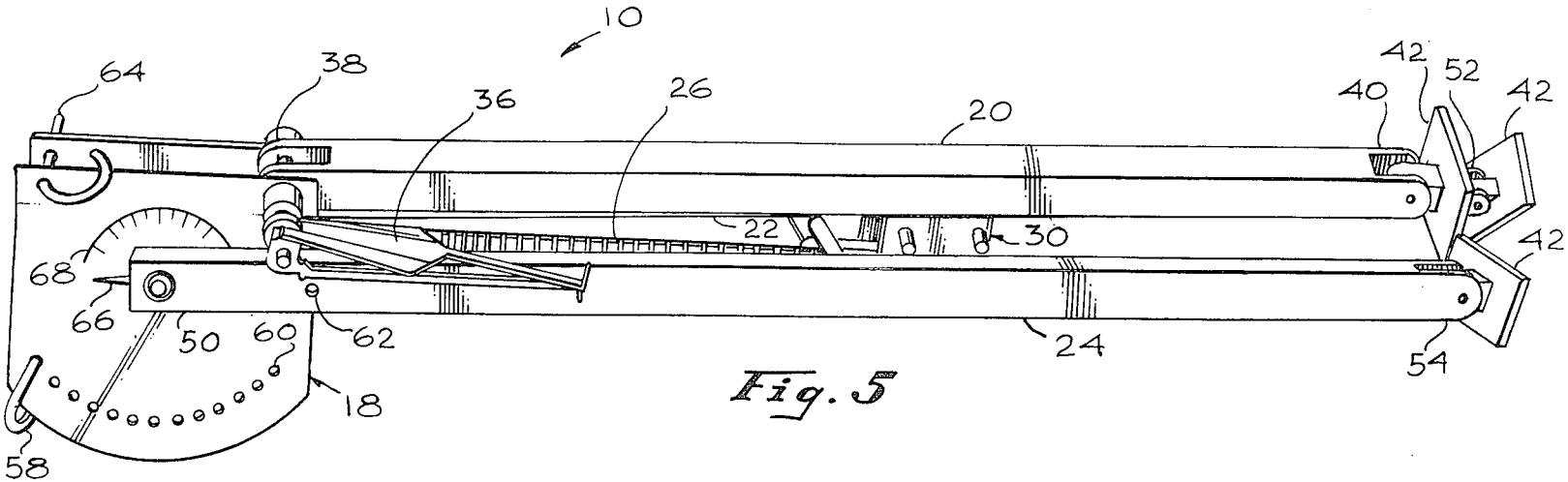
FIG. 5 illustrates one embodiment of the tripod in a folded position.

FIG. 5 illustrates the embodiment 10 described above in the folded position wherein the forward legs 22 and 24 are moved from the plurality of firing positions into the folded position and the base leg 20 is moved from the firing position thereof into the folded position.

Figure 4:
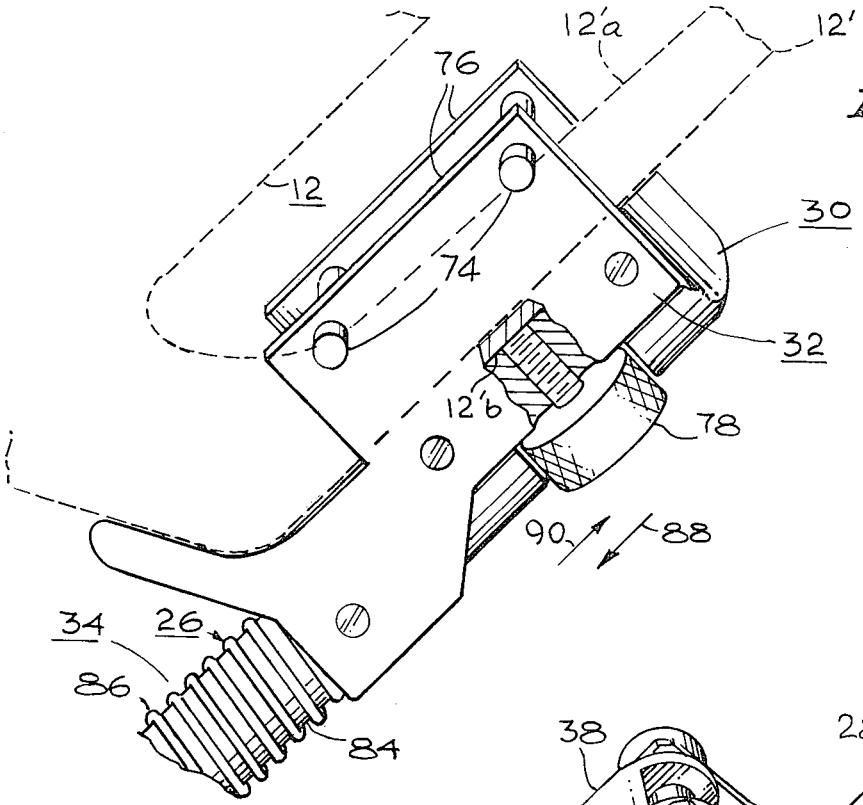
FIG. 4 illustrates the clamping arrangement for clamping a tripod to the launcher in one embodiment of the present invention.

FIG. 4 illustrates the structural details associated with a preferred embodiment of the clamping arrangement 32 utilized to detachably clamp the tripod launch support 18 to the launcher 12. As shown on FIG. 4 the launcher clamping means 32 is placed adjacent to the handle 12′ on the launcher 12 and pin means 72 extend through plates 76 adjacent the first side 12′a of the handle 12′. The pin means 74 are detachably positionable in the plates 76 so they may be inserted and removed in order to clamp or detach the launcher 12 from the tripod 16. A thumb screw 78 is provided in the launcher clamping means 32 abutting a second side 12'b of the handle 12'. When the thumb screw 78 is tightened the pins 74 are forced into a clamping engagement with the first side 12'a of the handle 12' for supporting launcher 12. Thus, with the above described preferred clamping arrangement no modifications to the M-16 rifle, or to any other launcher, is required. For the condition of the launcher 12 clamped in the launcher arrangement 32 of the tripod launch support 16 the angular relationship between the axis 80 of the barrel 12'' of the launcher 12, which is also the axis of the rocket boosted warhead round 14 at launch, must be known. Thus, if the axis 80 is parallel to the axis 46 then both the launch angle scale 68 and the level scale 72 may be calibrated with respect to the second axis 46. Otherwise, correct adjustments in the indications to achieve true launch angles for axis 80 must be provided.

The preferred embodiment of the present invention also incorporates recoil energy dissipation means 34 on the firearm support means 26 in order to dissipate at least a portion of the recoil energy associated with launching of the rocket boosted warhead round 14 from the firearm 12. It will be appreciated that many variations of energy dissipation means may be provided. For example, friction is one means of dissipating energy whereby the recoil energy is converted into heat energy by frictional engagement of two moving surfaces. Other types of energy dissipation means such as cyclic strain energy dissipating structures involving the cyclic straining of metallic or elastomeric elements can be utilized to dissipate energy. Springs, on the other hand, as known in the art, are merely energy storing devices and a perfect spring, of course, restores to the system all energy which it stores.

FIG. 8 illustrates one form of the recoil energy dissipation means 34 useful in the practice in the present invention. In this embodiment, launch support means 26 comprises a tube member 82 coupled to the body member 18. A piston 84 is slidingly mounted in the tube member 82 for sliding, friction engagement therewith, to provide a predetermined frictional force therebetween. A head portion 87 of the piston 84 prevents the piston from sliding out of engagement with the tube member 82. A return spring 86 is mounted on the piston 84 and abutting the tube member 82 and the launcher clamping means 32. The launcher clamping means 32 is coupled to the piston 84 at the second end 30 of the launcher support means 26.

During firing the tripod support time to full recoil is considerably greater than the time required for the rocket round to leave the launcher, thus the rocket round starts free flight without the introduction of launch perturbations.

In operation, when the launcher 12 is fired to launch the rocket boosted warhear round 14 therefrom the launcher 12 and the launcher clamping means 32 move downwardly as indicated by the arrow 88, against the return spring 86 and the frictional contact between the piston 84 and the tube means 82 absorbs a predetermined amount of the recoil energy. When the force associated with the recoil has decreased below the force exerted by the return spring 86, the return spring 86 returns the piston 84 in the direction of the arrow 90 and additional energy is absorbed by the frictional engagement of the piston 84 with tube means 82 during this return movement. Thus, any desired amount of the recoil energy maybe dissipated by adjusting the frictional fit between the tube member 82 and the piston 84.

Additionally, recoil energy is also dissipated by elastic deformation of the structural elements comprising the launch support 16.

FIGS. 6 and 7 illustrates, in sectional view, the preferred structural arrangements for the footpads 42. FIGS. 6 and 7 shows the footpad 42 coupled to the base leg 20 and it will be appreciated that identical structural arrangements may be utilize in the forward legs 22 and 24. The footpad 42 comprises a base plate 92 having a predetermined bearing surface for resting upon the ground and a connecting portion 94 extending therefrom. The connecting portion 94 is pivotally coupled to the second end 40 of the base leg 20.

In order to accommodate the connecting portion 94, the lower end 40 of the base leg 20 is bifuracted to provide the two flanges 98 and 100 defining channel 102. The connecting portion 94 is positioned in the channel 102 and restrained therein by the pivot pin 96.

A ball and socket connection may also be utilized for coupling the footpads to the legs.

Figure 9:
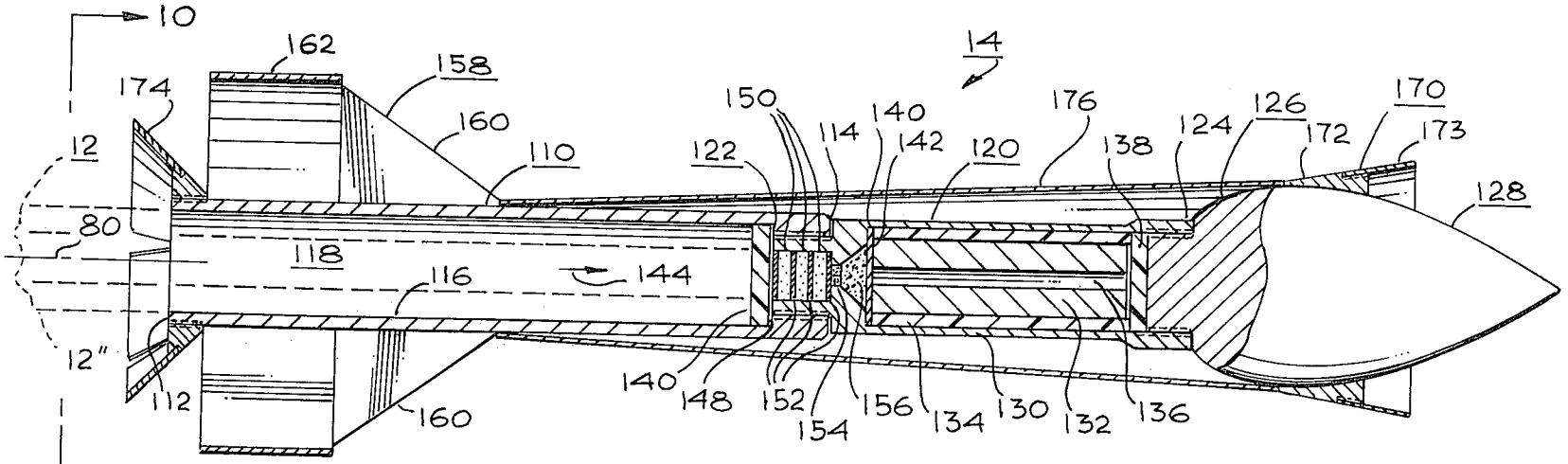
FIG. 9 is a sectional view of one embodiment of a rocket boosted warhead round useful in a practice of the present invention.
Figure 10:
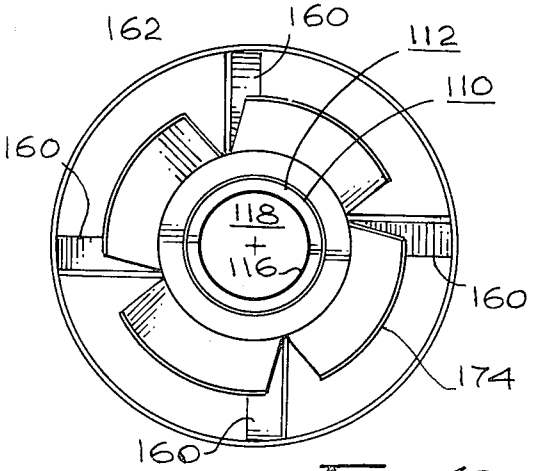
FIG. 10 is a view along the line 10—10 of FIG. 9.

Referring now to FIGS. 9 and 10 there is illustrated one embodiment of the rocket boosted warhead round 14 useful in the practice of the present invention. The rocket boosted warhead round 14 is launched from a launcher 12, such as the M-16 rifle, any may be launched therefrom with the launcher 12 supported by the tripod launch support 16 described above, or with any other type of support means desired for holding the launcher 12 during launch of the rocket boosted warhead round 14.

The rocket boosted warhead round 14 is generally comprised of a tubular tailpipe means 110 having an aft end 112, a forward end 114 and internal walls 116 defining a tubular passageway 118 there through. The tubular passageway 118 is adapted to slidingly fit on the end of the barrel 12'' of the launcher 12, as illustrated in FIG. 9.

A rocket motor 120 has an aft end 122 that is coupled, for example by threading engagement, to the forward end 114 of the tailpipe 110. The rocket motor 120 also has a forward end 124 to which there is coupled, for example, by threading engagement thereto, a warhead 126. The warhead 126 has external walls 128 defining a predetermined ogive configuration selected to provide any predetermined aerodynamic characteristics desired.

The rocket motor 120 generally comprises a rocket motor casing 130, a solid propellant grain 132 mounted in the casing 130 with an inhibiter 134 therebetween to inhibit combustion on the external surfaces thereof. The solid propellant grain 132 is designated to ignite along the internal walls 136. A cushion disc 138 may be provided intermediate the warhead 126 and solid propellant grain 132 and a separation disc 140 may be provided intermediate the rocket motor casing 130 and the solid propellant grain 132 along the aft edge 142 of the solid propellant grain 132.

The rocket boosted warhear round 114 is launched from the launcher 12 by means of the hot gaseous products generated in the launcher 12 by firing of a blank round therein. The hot gaseous products of combustion enter the tubular passageway 118 in the direction indicated by the arrow 144. The pressurized hot gaseous products of combustion impinge against the ignition plug 146 to launch the rocket boosted warhead round 14 from the firearm 12. The ignition plug 146 deflagrates and, in turn, ignites a first fire mixture 148. First fire mixture 148 then ignites, sequentially, one or more deflagrating delay composition mixes 150. The number and axial thickness in the direction of the axis 80 of each of the delay composition mixes 150 may be selected to provide any given time period of delay desired to provide ignition of the solid-propellant rocket grain 132 a predetermined time after launching from the launcher 12. The individual delay composition mixes 150 may be separated from each other by, for example, screens 152 and after the delay composition mixes 150 are ignited, a deflagrating transfer mixture 154 is ignited. The transfer mixture 154 ignites the ignition composition 156 which, in turn ignites the internal walls 136 of the solid propellant grain 132. When the internal walls 136 commence deflagration the hot gaseous products generated thereby are exhausted from the aft end 112 of the tailpipe 110 and the rocket boosted warhead round is powered thereby during flight.

In order to provide stability to the flight of the rocket, the preferred embodiment of rocket boosted warhead rounds utilized in the present invention incorporate aero-gyro stability. Aero-gyro stability means 158 are coupled to the tailpipe 110 adjacent to aft end 112 thereof and generally comprises a plurality of fins 160 and a ring 162. The fins 160 have a canted portion that is not aligned with the axis 80 to provide spin stabilization during flight. For example, there may be provided three or more fins 160 and in the embodiment 14 there has been illustrated four fins 160. The angle of cant may be selected, for example, to be between 5 and 20 degrees as required for effective spin rates.

When the rocket is launched under the forces exerted by the hot gaseous products of combustion generated by firing the blank cartridge in the launcher 12, the rocket boosted warhead round 14 commences to spin. The time delay may be selected to provide, for example, one-tenth of a second flight before the solid propellant grain 132 is ignited. During this one-tenth of a second flight the rocket boosted warhead round 14 achieves a spin rate that is an order of magnitude larger than the yawing frequency thereof for the non-spin condition. As utilized herein, therefore, aero-gyro stability is defined to mean the condition when the center of pressure is aft of the center of gravity and there is a spin rate of the rocket boosted warhead round 14 that is at least one order of magnitude larger than the yawing frequency of the rocket boosted warhead round 14 for the rocket boosted warhead round 14 in the non-spin condition.

Since the range of the rocket boosted warhead round 14 depends upon the drag characteristics thereof, in the preferred embodiments of the present invention detachably mountable means are utilized to vary the drag characteristics in order to achieve the variations in the range of the rocket boosted warhead round 14 for a given angle of launch. This effect is called zoning and, for example, to decrease the range for a given angle of launch a forward drag shroud means 170 may be detachably coupled to the warhead 126.

As shown on FIG. 9 the forward drag shroud means 170 is comprised of two sections, a base section 172 and an outer section 173. The base section 172 may be frictionally coupled to the warhead 126 and increases the drag of the round 14 a first predetermined amount in order to decrease the range. If a greater decrease in range is desired, the outer section 173 may be frictionally coupled to the base section 172 in order to further increase the drag. Thus, forward drag shroud 170, as illustrated, can provide three zones of firing range:

1. The minimum range is achieved with incorporation of both the base section 172 and outer section 173;
2. An intermediate range is achieved by incorporation of only the base section 172; and
3. A maximum range is achieved by omitting the forward drag shroud 170.

If a further decrease in the range is desired an aft drag means 174 may be detachably coupled to the aft end 112 of the tailpipe 110 by, for example, a threading engagement, and the aft drag means 174 further decreases the range to give a greater zone affect for a given angle of launch. The aft drag means 174 may be utilized either in conjunction with or instead of forward drag shroud means 170.

Alternatively, if it is desired to increase the maximum range the drag must be decreased. Thus, to achieve an increase in the maximum range for a given angle of launch, for the round configuration shown on FIG. 9, a streamlined fairing 176, detachably coupled to the warhead 126 and to the tailpipe 110, may be utilized. For the configuration of the rocket boosted warhead round 14 shown in FIGS. 9 and 10 the streamlined fairing 176 may be installed by detaching the warhead 126 from the rocket motor casing 130 and installing the streamline fairing 126 over the tailpipe 110. The warhead 126 may then be attached to the rocket motor casing 130. The streamlining effect provided by the streamlined fairing 176 increases the range for a given angle of launch of the rocket boosted warhead round 14.

Appropriate firing tables are utilized to show the range for each configuration of the round 14, that is, with any combination of drag shrouds or other drag inducing means, without drag shrouds, and with utilization of a streamlined fairing for both the firing conditions of launch firing the rocket motor and with firing of the rocket motor.

It will be appreciated, or course, that minimum weight of the round 14 is desirable in order to facilitate logistic supply of the round as well as transportation thereof by individual personnel. Thus, non-essential structure is preferably omitted from the "clean" round configuration and zoning is provided by comparatively light weight, separately attachable structure.

Figure 11:
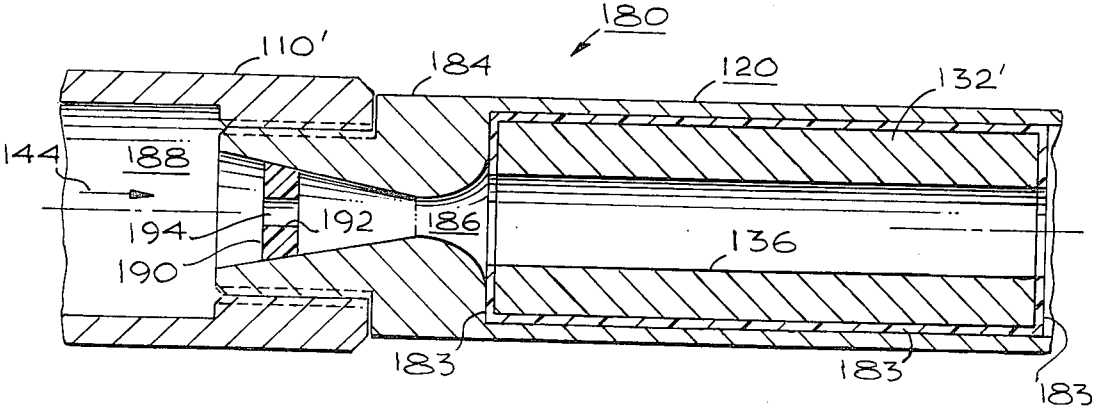
FIG. 11 illustrates another embodiment of a rocket boosted warhead round.

FIG. 11 illustrates another embodiment, generally designated 180, of the rocket boosted warhead round useful in the present invention. In general, the rocket boosted warhead round 180 provides an alternative structure for achieving the desired ignition delay between launch of the rocket boosted warhead round 180 and ignition of the solid propellant grain 132'. In the embodiment 180 the rocket motor casing 120 is provided with a convergent-divergent nozzle portion 184 having a convergent portion 186 adjacent to the solid propellant rocket grain 132' and a divergent portion 188 in the tailpipe 110' spaced from the solid propellant grain 132'. A plug means 190 is frictionally retained in the divergent portion 188 of the nozzle 184 by a predetermined frictional force therebetween and has internal walls 192 defining an aperture 194 therethrough. Aperture 194 has aa preselected diameter. The aperture 194 acts as a metering orifice for limiting the amount of hot gaseous products of combustion, generated by firing a blank cartridge in the launcher utilized to launch the rocket boosted warhead round 180 passing therethrough and thus limits the amount of hot gaseous products of combustion that impinge upon the internal walls 136' of the solid propellant grain 132' providing ignition thereof. By suitably limiting the initial burning surface of the grain with an inhibitor 183 along the periphery and the end surfaces of the grain 132', the initiation of effective thrust of the rocket grain 132' may be suitably delayed. This delay, for example, may be in the order of one-tenth of a second, as noted above by properly sizing the initial burning surface of the grain to achieve a progressive burn.

In the embodiment 180 shown in FIG. 11, when the solid propellant grain 132' is ignited, hot gaseous products of combustion under pressure are emitted therefrom. The pressure from the hot products of combustion are directed onto the plug means 190 in the direction opposition to the direction of the arrow 144. Therefore, the frictional force retaining the plug in the position shown in FIG. 11 is preselected to be less than the pressure force exerted on the plug after the solid propellant grain 132' is ignited. The plug means 190 is therefore forced from the divergent portion 188 of the convergent-divergent nozzle 184 and moves through the tailpipe 110' for ejection from the rocket boosted warhead round 180.

Figure 12:
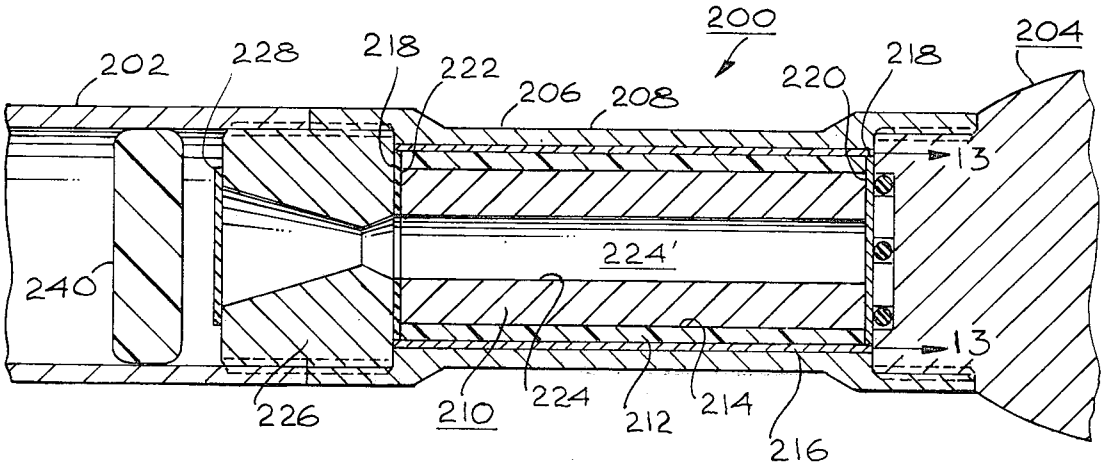
FIG. 12 illustrates another embodiment of a rocket boosted warhead round.
Figure 13:
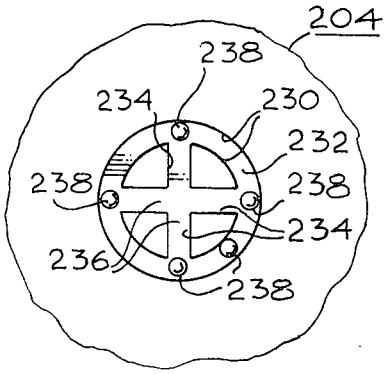
FIG. 13 is a sectional view along the line 13—13 of FIG. 12.

FIGS. 12 and 13 illustrate another embodiment, generally designated 200, of the rocket boosted round useful in the practice of the present invention. The rocket boosted round 200 is provided with a tailpipe 202 which, in general, may be similar to tailpipe 110 described above and may be provided with an aero-gyro stabilization means (not shown) such as the canted fins and ring tail configuration shown in FIG. 9. Similarly, a warhead 204 which may be, in general, similar to the warhead 126 shown on FIG. 9 may also be provided.

A rocket motor 206 comprising a rocket motor casing 208 is coupled, for example by threading engagement, to the tailpipe 202 and warhead 204. The rocket motor 206 has a solid propellant grain 210 positioned therein. The solid propellant grain 210 is encased within a plastic tube, for example a polyvinyl chloride tube 212 along the axial peripheral edges 214 thereof and is bonded by, for example, a silicone plastic bond 216 to the rocket motor casing 208. The polyvinyl chloride tube 212 inhibits burning along the axial peripheral edges 214 of the solid propellant grain 210. An inhibitor disc, such as a fiberglass disc 218, is bonded to both the forward and aft end surfaces 220 and 222, respectively, of the solid propellant grain 210 to inhibit burning on the surfaces.

The solid propellant grain 210 is also provided with internal walls 224 defining the central passageway 224' extending from the aft end 222 to the forward end 220.

A nozzle means 226 is coupled to the rocket motor casing 203 and to the tailpipe 202 adjacent aft end 222 of the solid propellant grain 210 and is closed by a closure disc 228 that is sealed or otherwise coupled to the nozzle means 226. Thus, the solid propellant grain 210 is hermetically sealed in the round 200 to prevent deterioration of the characteristics thereof due to exposure to environmental conditions.

The warhead 204, illustrated more clearly on FIG. 13 is provided with first walls 230 defining a toroidal groove 232 there around adjacent the forward end 220 of the solid propellant grain 210 and also with second walls 234 defining passageways 236 communicating with the toroidal groove 232. A plurality of ignitor pellets 238 are coupled to the warhead 204 in the toroidal groove 232 adjacent to the passageways 236 to provide four igniter pellets. A fifth igniter pellet may be positioned as desired in the toroidal groove 232 to provide a total of five igniter pellets. The ignitor pellets 238 may be, for example, $BKNO_3$.

When the rocket boosted warhead round 200 is launched, the hot gases generated from firing the blank cartridge ruptures the closure disc 228 and enters the nozzle means 226. The hot gases pass through the passageway 224' defined by the internal walls 224 and enter the passageway 236 in the warhead 204. The hot gases impinge on the igniter pellets 238 and the igniter pellets 238 are ignited and the hot products of combustion therefrom pass back through the passageway 236 and impinge against the internal walls 224 of the solid propellant grain 210 to provide ignition thereon. The solid propellant grain 210 is thus ignited and thrust commences. In this embodiment of the solid propellant grain 210, the area of the internal walls 224 is carefully selected to provide a comparatively low thrust at the start of ignition. The area increases progressively as the grain burns and thus the thrust increases. The comparatively low thrust at the onset of ignition insures that the personnel launching the round 200 are not injured by back blast therefrom.

When it is desired to launch the round 200 without firing the grain 210, a plug means 240 may be inserted into the tailpipe 202 and retained therein by a frictional fit. The plug means 240 may be, for example, fabricated from rubber, or the like, and may equally well be utilized in the embodiments shown in FIGS. 9 and 11.

FIG. 14 illustrates the thrust-time relationship for the solid propellant grain 210 as utilized with a 50 mm warhead. As such, the solid propellant grain 210 has an axial length of 2.5 inches, an outside diameter of 0.95 inches and the initial internal diameter of the passageway 224' was 0.375 inches. The grain was inhibited on both ends and on the peripheral edges. The nozzle means 226 had a divergent half angle of 20°. As can be seen from FIG. 14, the time until rocket motor burn out is approximately 0.51 seconds and the maximum thrust achieved was 57 pounds at 0.46 seconds. The total impulse achieved was 14.3 pound seconds.

Test firing of the rocket boosted round 200 in a 50 millimeter warhead configuration with a total weight of the round on the order of 1.5 pounds, and with a 14 degree cant to the four fins in the aero-gyro stabilization means, the round 200 achieved the linear velocity oof approximately 470 feet per second at rocket motor burn out (0.51 seconds after launch) and a spin rate of approximately 7,200 revolution per minute. Due to the aero-gyro stability in the preferred embodiments of the present invention the spin rate is generally on the order of 1.6 times the linear velocity and thus automatically assumes the proper spin rate for aero-gyro stability throughout the flight of the round for any linear velocity thereof.

As noted above the improved rocket boosted warhead round and launch support utilizing a recoil tripod for support of the launcher provides a light weight, low recoil, extended range, low cost, and easy to use weapon system that may be conveniently deployed at the squad level, in contradistinction to the 60 millimeter or 81 millimeter mortars which are deployed at the division and/or company level.

Current rifle grenades, such as the M-79 grenade system or the M-203 system have a maximum range of approximately 400 meters and an effective range of 350 meters. At a range of approximately 350 meters a person utilizing such a grenade system as the M-79 or M-203 is within small arms fire range from the enemy. The M-79 requires a 6 ½ pound launcher and the M-203 requires a 3 pound launcher. The M-203 grenades, for example, are only on the order of ½ pound. The present invention utilizing a 1 ½ pound rocket boosted round in the 50 millimeter size which may be equipped, for example, with an M-550 fuse and a dual purpose (HEDP) warhead, fired from a 2 ½ pound recoiling launcher support can provide an effective range over 3 times the effective range of the M-203 and a warhead effectiveness against both personnel and armor approximately twice that achieved by the M-203 grenade system.

The conventional 60 millimeter mortar requires a launcher weighting approximately 45 pounds and each high explosive round therefor weights approximately 3 pounds. The invention of the present system utilizing the 2 ½ pound recoiling tripod launcher support and the 1 ½ pound dual purpose rocket boosted warhead round achieves the same range effectiveness and thus allows deployment at the squad or platoon level.

The 81 millimeter mortar requires a launcher weight of approximately 115 pounds and a round weight of approximately 9 pounds. A 75 millimeter rocket boosted warhead round in accordance with the present invention requires approximately a 25 pound two piece, man portable launcher and support and approximately a 4 ½ pound fragmention rounds to achieve the same range and effectiveness as the 81 millimeter mortar.

Thus, a weapon system in accordance with the structure of the present invention provides a must lighter weight and easier to use weapon system having a lower recoil and extended range for firing of the round.

It has been found that the impact pattern of rocket boosted warhead rounds fabricated in accordance with the principles of the present invention are must smaller than corresponding impact patterns for 81 millimeter or 60 millimeter mortars.

Figure 15:
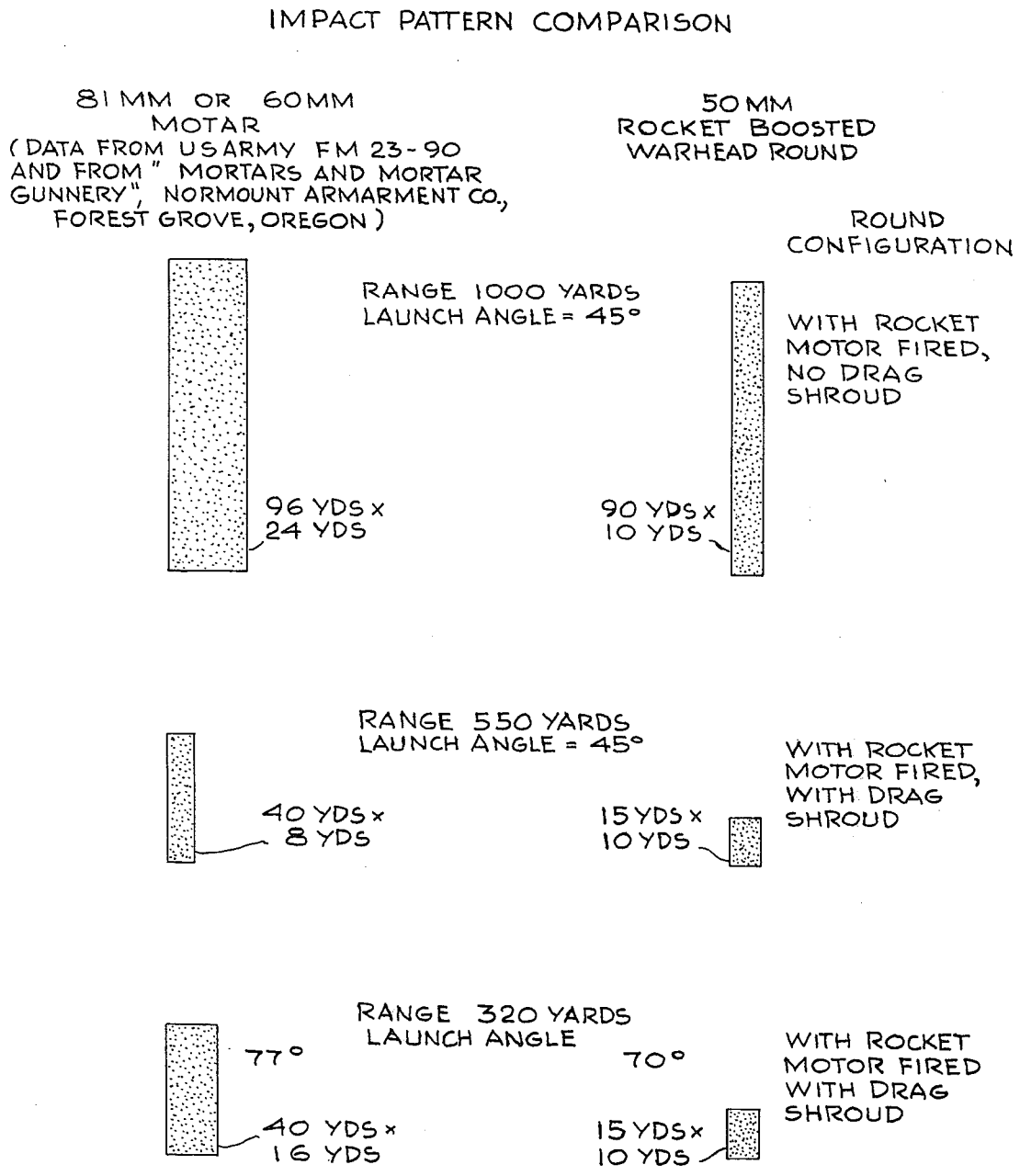
FIG. 15 illustrates a graphical comparison of impact areas.

FIG. 15 illustrates a comparison of the impact pattern obtained during firing of a 50 millimeter rocket boosted warhead round, such as that illustrated in FIG. 12, having a rocket motor with performance characteristics as illustrated in FIG. 14 with the published data on the impact patterns from 81 millimeter and 60 millimeter mortars. The data on the 81 millimeter and 60 millimeter mortars are from the U.S. Army Field Manual FM23-90 and the publication "Mortars and Mortar Cunnery," Normount Armement Company, Forest Grove, Oregon. As can be seen from FIG. 15, the rocket boosted warhead round, in accordance with the structure of the present invention, achieved a constant 10 yard wide pattern at the test ranges 320 yards, 550 yards, 1,000 yards. The target pattern for the 81 millimeter or 60 millimeter mortars at 1,000 yards and 550 yards are approximately twice as large in area as the patterns of the rocket boosted warhead round in accordance with present invention. For the high angle firing at the comparatively short range of 320 yards the pattern for the 81 millimeter and 60 millimeter mortars are approximately four times as large as the pattern for rocket boosted warhead rounds in accordance with the present invention. As a result, utilization of the structure of the present invention requires that only approximately ½ the number of rounds per target need be fired to achieve the same kill probability and the rocket boosted warhead round of the present invention has approximately ½ the weight of the corresponding mortar rounds. Thus, the overall system of the present invention provides an increase of effectiveness of approximately four times over the existing 60 millimeter or 81 millimeter mortars.

It will be appreciated that the structure of the present system also be utilized for line and equipment casting, grapling hook casting, as well as casting of inflatable life preservers. Similarly, mines may also be source deployed and with electrical connection suitably provided to the round the mines may be controlled for desired detonation.

In addition to conventional warhead rounds, illumination rounds, signal rounds, and/or smoke rounds may be utilized by adaptation to the appropriate warhead configuration.

The aero-gyro stabilization of the rounds provided by the canted fins and ring tail achieves rapid spin up and tends to minimize any thrust, mass or aerodynamic misalignments as well as rapidly damping any free flight perturbations. Further, it has been found that such aero-gyro stabilization also alllows the yaw angle that is required for effective trailing to approach zero. Incorporation of easily installed and removable shrouds for either increasing the drage to decrease the range or streamlining to increase the range provides effective range zoning for firing the rounds. The recoiling type launcher support of the present invention provides a stable platform for accurate aiming and precision sustained or repititive firing of the round. The recoil structure of the present invention minimizes launch perturbations and the structure may be conveniently folded into a compact package for easy transportation thereof and rapid setup.

This concludes the description of the preferred embodiments of the present invention. Those skilled in the art may find many variations and adaptation thereof and the appended claims are intended to cover all variations and adaptations falling within the true scope and spirit of the invention.

We claim:

1. In a weapon system arrangement comprising a rocket boosted warhead round having a center of gravity, a center of pressure and a predetermined non-yawing frequency, and a launcher for launching the round, the improvement comprising, in combination:

a launcher comprising a tripod support, a barrell portion and means for firing a blank cartridge to direct the products of combustion from the fired blank cartridge through the barrel portion, and said tripod support comprising:

a body member;

a base leg having a first end coupled to said body member and a second end spaced a first preselected distance from said first end, and said base leg extending in a first direction from said body member for the condition of said base leg in a firing position;

a pair of forward legs and each of said forward legs having a first end pivotally coupled to said body member and a second end spaced a second preselected distance from said first end thereof, and said pair of forward legs in a predetermined spaced relationship to each other and to said base leg;

forward leg clamping means engaging each of said pair of forward legs and said body member for detachably clamping each of said forward legs in any of a plurality of firing positions on said body member;

launcher support means having a first end coupled to said body member, and a second end spaced therefrom, and said launcher support means extending from said body member in a second direction;

launcher clamping means coupled to said second end of said launcher support means for detachably coupling said launcher thereto;

recoil energy dissipation means coupled to said launcher support means for dissipating at least a portion of recoil energy applied thereto;

position indicating means on said body member for providing a visual indication of each of said plurality of firing positions of said forward legs;

level means pivotally mounted on said body member and alignable thereon in a level condition for depicting a level condition of the tripod support for the condition of said forward legs clamped in any of said plurality of firing positions, and said level indicating means coupled to said body member for providing a visual indication of the level condition of said level means corresponding to said position indicating means for each of said plurality of firing positions of said pair of forward legs, and having two axis level indication means comprising a pair of bubble sight levels orthogonally aligned;

round for launching from said launcher and comprising:

a tubular tailpipe means having an aft end, a forward end, and internal walls defining a tubular passageway, and said tubular passageway at said aft end adapted to slidingly fit onto the end of the launcher barrel;

a rocket motor having an aft end coupled to said forward end of said tailpipe, and a forward end, and comprising a solid propellant rocket grain;

a warhead coupled to said forward end of said rocket motor, and said warhead having a predetermined ogive external configuration;

a delay means in said rocket motor for providing a predetermined delay to full thrust of said rocket motor, aero-gyro stabilization means coupled to said aft end of said tubular tailpipe for spinning said round to provide aero-gyro stability, said aero-gyro stability comprising wherein said center of pressure is aft of said center of gravity and the round is spinning at a rate at least of one order of megnitude greater than said predetermined non-spinning yawing frequency.

2. The arrangement defined in claim 1 wherein:

said base leg is pivotally coupled at said first end thereof to said body member, and pivotally movable thereon from said firing position to a folded position adjacent said launcher support means;

and further comprising:

base leg clamping means operatively engaging said base leg and said body member for detachably clamping said base leg to said body member in said firing position thereof; and said pair of forward legs pivotally movable on said body member from said plurality of firing positions to a folded position adjacent said launcher support means.

3. The arrangement defined in claim 2 wherein said launcher further comprises:

a tube member mounted on said body member;

a piston slidingly mounted in said tube member for reciprocating motion therein, and having a first end and a second end spaced in said second direction from said first end;

said launcher clamping means coupled to said second end of said piston;

and said recoil energy dissipation means further comprises a compression coil spring means mounted on said piston and abutting said tube member and said launcher clamping means.

* * * * *